US006676723B2

(12) United States Patent
Chwala

(10) Patent No.: US 6,676,723 B2
(45) Date of Patent: Jan. 13, 2004

(54) GREASE CONTAINMENT ASSEMBLY

(75) Inventor: Kevin Chwala, Barrington Hills, IL (US)

(73) Assignee: Omni Containment Systems, Inc., Chicago, IL (US)

( * ) Notice: Subject to any disclaimer, the term of this patent is extended or adjusted under 35 U.S.C. 154(b) by 0 days.

(21) Appl. No.: 10/206,767

(22) Filed: Jul. 29, 2002

(65) Prior Publication Data

US 2003/0005670 A1 Jan. 9, 2003

Related U.S. Application Data

(63) Continuation-in-part of application No. 09/900,549, filed on Jul. 9, 2001, now Pat. No. 6,468,323.

(51) Int. Cl.[7] ..... B01D 35/02

(52) U.S. Cl. ..... 55/421; 55/462; 55/490; 55/506; 55/DIG. 36; 126/300; 454/49; 210/188

(58) Field of Search ..... 55/421, 428, 462, 55/490, 502, 506, 507, DIG. 31, DIG. 36; 126/299 D, 299 E, 299 R, 300, 301; 454/49, 365; 210/154, 188, 407

(56) References Cited

U.S. PATENT DOCUMENTS

| | | | | |
|---|---|---|---|---|
| 4,635,617 A | | 1/1987 | Simonsen | 126/299 |
| 4,869,236 A | | 9/1989 | Blough | 126/299 |
| 4,887,588 A | | 12/1989 | Rial | 126/299 |
| 5,196,040 A | | 3/1993 | Malloy et al. | 55/323 |
| 5,318,607 A | | 6/1994 | Malloy et al. | 55/323 |
| 5,512,073 A | | 4/1996 | Mirza et al. | 55/323 |
| 5,567,216 A | | 10/1996 | Mirza et al. | 55/323 |
| 5,814,115 A | | 9/1998 | Allen et al. | 55/350.1 |
| 6,010,558 A | | 1/2000 | Ackland | 95/141 |
| 6,143,047 A | | 11/2000 | Jodoin et al. | 55/323 |
| 6,391,074 B1 | | 5/2002 | McCrary | 55/321 |
| 6,468,323 B1 | * | 10/2002 | Chwala | 55/490 |

* cited by examiner

*Primary Examiner*—Frank M. Lawrence
(74) *Attorney, Agent, or Firm*—Much Shelist; Adam K Sacharoff

(57) ABSTRACT

A grease containment assembly to collect grease discharged from a grease exhaust system that has an exhaust duct extending upwardly from a roof top and interconnected to a fan base that connects to an exhaust fan. The grease containment includes a plurality of interconnecting channels positioned around the exhaust duct to form a frame surrounding the exhaust duct. The channels further include a water channel running along the bottom portion defined therein. A sorbent material is further received within the interconnecting channels, having properties that absorbs grease and repels water. A plurality of egresses positioned in the interconnecting channels permit water running along the water channels to drain out of the interconnecting channels.

14 Claims, 9 Drawing Sheets

GREASE CONTAINMENT ASSEMBLY

CROSS-REFERENCE TO RELATED APPLICATIONS

This application is a continuation in part application, related to U.S. patent application Ser. No. 09/900,549, entitled Grease Containment Assembly, filed Jul. 9, 2001, now U.S. Pat. No. 6,468,323, and incorporated by reference herein, with priority claimed for all commonly disclosed subject matter.

This invention relates generally to a grease containment assembly for collecting grease discharged from vents.

BACKGROUND OF THE INVENTION

Restaurants, especially fast food establishments, produce high volumes of grease that is discharged through a roof-mounted exhaust system. The grease that is discharged may accumulate on the roof and cause deterioration and/or pose extreme fire hazards. Known attempts to contain the grease generally result in less that efficient means for containing the discharged grease.

One such attempt is disclosed in U.S. Pat. No. 5,196,040 entitled "Grease Trap and Filter Apparatus," ('040 patent) which the applicant herein co-invented. However, the '040 patent has numerous shortcomings. For instance, the filter assembly is designed and cut to fit snugly around the exhaust duct of an exhaust system. However, the grease may still easily run in between the duct and the filter spilling on to the roof.

U.S. Pat. No. 5,512,073 entitled "Grease Filter Assembly" ('073 patent) is another attempt to contain the grease that may be discharged through a roof top exhaust system. Similar to the above, the '073 patent also places the filter directed against the exhaust duct. However, the '073 patent is secured to the duct rather than the roof, allowing it to be placed on any roof, even if slanted.

U.S. Pat. No. 5,567,216 entitled "Grease Filter Assembly" ('216 patent) places a filter directed below the grease spout. However, it is well known that the grease has a tendency to expel from any openings in the seams around the entire perimeter of the exhaust duct, vent and under the fan base as well.

U.S. Pat. No. 6,010,558 entitled "Grease Containment System and Method for Absorbing Grease" ('558 patent) is directed to a system that uses a box to collect grease falling from the spout as well as a filter mat placed around the vent to collect run off grease. However, as the above-mentioned patents, the '558 patent is simply fitted about the exhaust duct such that the grease may fall in between the filter and the duct.

U.S. Pat. No. 6,143,047 entitled "Effluent Containment Assembly" is directed to a containment system for collecting grease or other effluents that dispense from a exhaust system. The various disclosed systems may be mounted to the duct above the roof and include a flashing member to direct the effluent downwardly and outwardly away from the vent. However, since the filter material is cut and sized about the duct, grease may still seep in between the filter and the duct and onto the roof As noted above, most grease containment assemblies use filters that are cut and sized to fit about the perimeter of the exhaust duct. In some instances the exhaust system includes a grease spout that is suppose to direct the grease into a small grease trap, as shown and described in U.S. Pat. No. 6,143,047 and U.S. Pat. No. 6,010,558. However, the grease has a tendency to seep through seems between the filter pads and the duct as well as around the fan base between the exhaust duct and fan. As such in each instance the grease will still saturate the roof causing deterioration and posing fire risks. A need therefore exists for improvements on the above-mentioned references in order to prevent the grease from saturating and deteriorating the roof.

SUMMARY OF THE INVENTION

In accordance with the present invention a grease containment assembly is described and disclosed herein below. The grease containment assembly includes a plurality of elongated members positioned about the perimeter of an exhaust system. Each elongated member has a bottom portion and two walls extending upwardly from the bottom portion, wherein one of the walls is positioned up against the exhaust duct defined in the exhaust system and the other wall is a predetermined distance therefrom defined by a width of the bottom portion. The containment assembly further includes a means for securing the elongated members against the exhaust duct, such as support brackets. A sorbent pad is sized to fit entirely within the elongated members and has properties to absorb grease and to permit water to drain through or repel therefrom. The elongated members further includes a plurality of drain holes interspaced about the bottom portion such that water not absorbed or repelled by the sorbent pad may drain from the containment assembly. Other embodiments include placing a mesh covering on top of the sorbent material to help prevent the sorbent material from moving.

In another embodiment of the present invention, the elongated members may include a water channel running along the bottom portion thereof. The corner or angled section would further include egresses that aligned with the water channel such that water repelled by the sorbet material could drain out of the containment assembly.

In addition, the flashing guard could be an integral component of the elongated members rather than being separate. Also, the screen could be replaced by having a section extending out from the wall proximal to the exhaust duct to the wall distal thereto.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
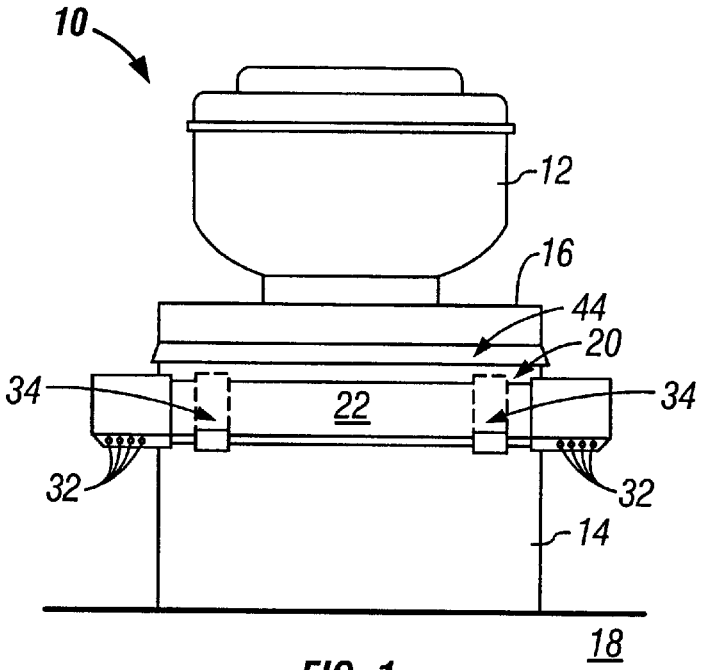
FIG. 1 is a side view of the grease containment assembly in accordance with the present invention attached to a typical grease exhaust system.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a grease containment assembly in accordance with the present invention is hereinafter generally referenced to numeral 20. The grease containment assembly 20 is to be used with a roof top grease exhaust system 10. The grease exhaust system 10 would typically include at least, an exhaust fan 12 and an exhaust duct 14 that protrudes from a roof 18 of a building, normally a fast food restaurant. The grease exhaust system 10 may also include a grease spout (not shown) that aids in directing the discharged grease out of the exhaust system 10. While ideally grease is meant to collect and discharge through the grease spout, the grease typically discharges around the fan base 16 that serves to connect the exhaust fan 12 to the exhaust duct 18. The grease containment assembly 20 of the present invention serves to solve the ever present problem of collecting the discharged grease.

Figure 2:
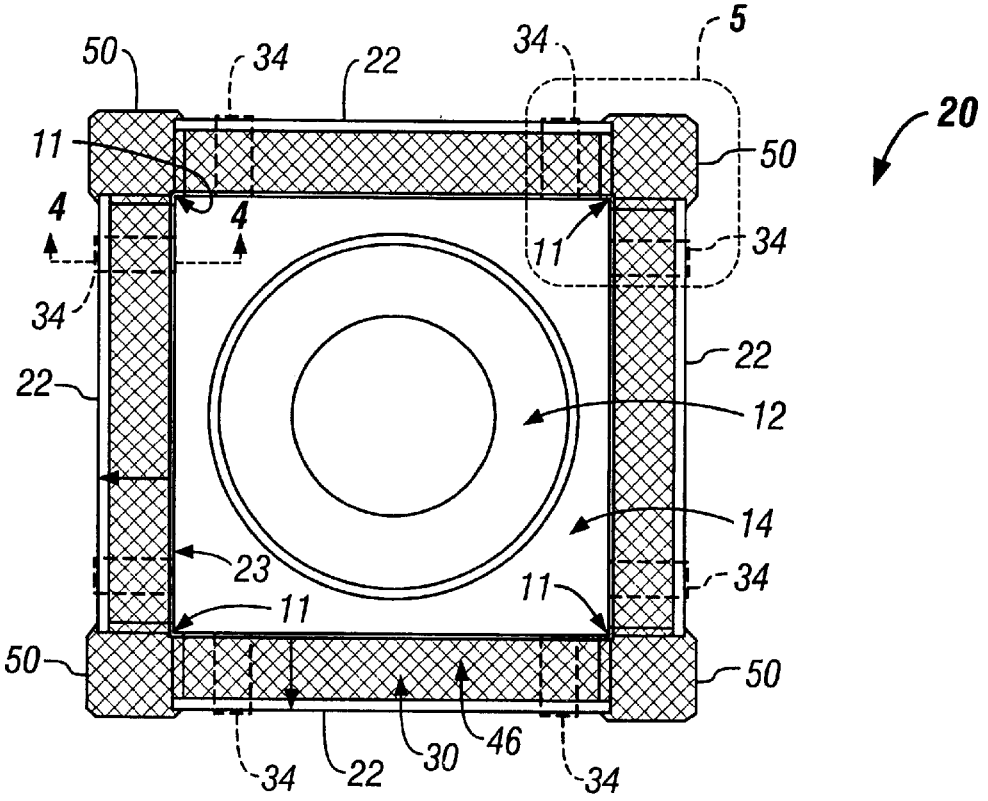
FIG. 2 is a top view of the grease containment assembly from FIG. 1.
Figure 4:
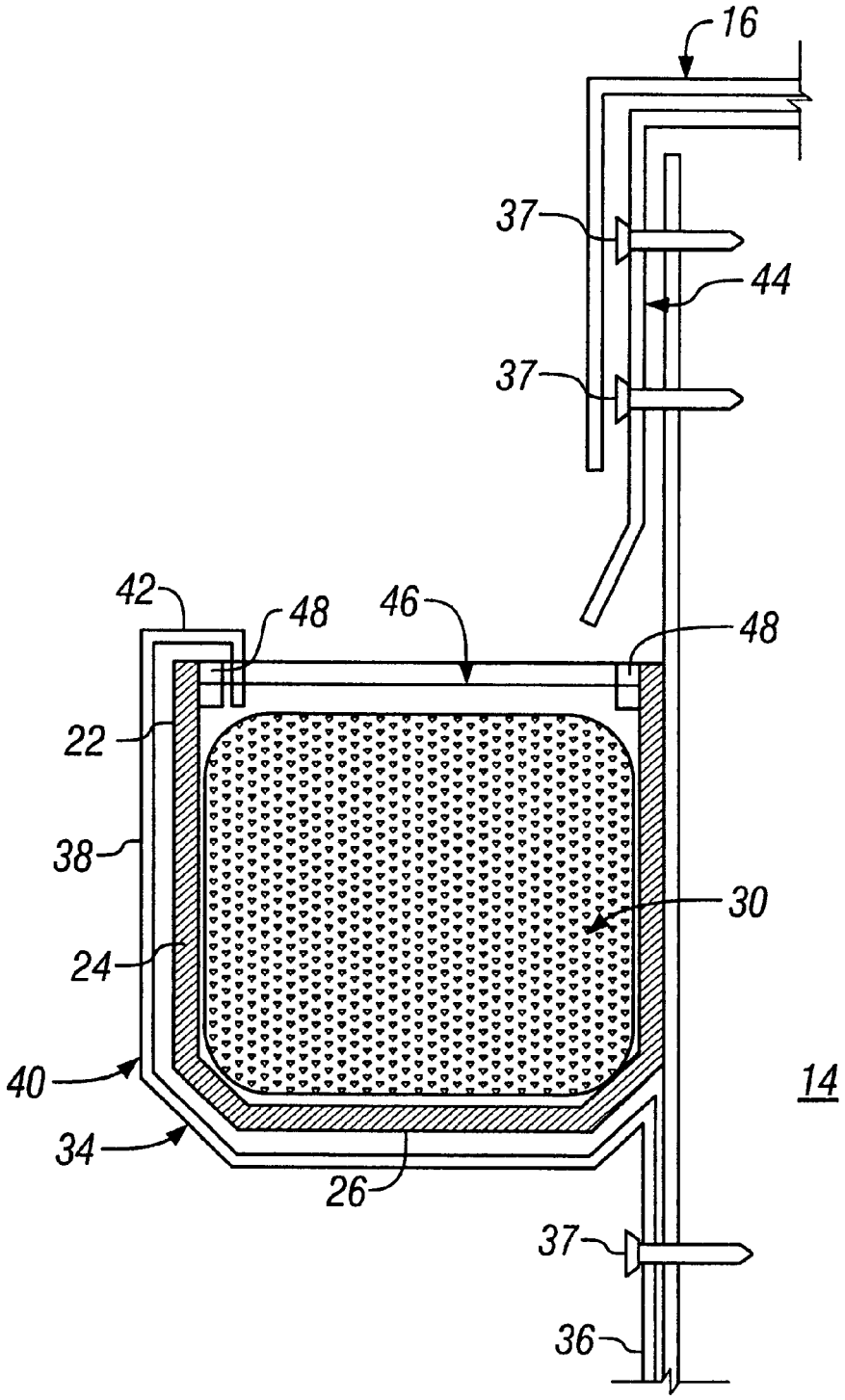
FIG. 4 is a front view of the grease containment assembly from FIG. 2 taken about cross section line 4—4.

Referring also now to FIG. 2, the grease containment assembly 20 includes a frame defined by a plurality of elongated members 22 that are positioned against the exhaust duct 14 and below the fan base 16 (FIGS. 1 and 4). While the grease containment assembly 20 is illustrated as being square shaped, it is not intended to be limited by the illustrations, the present invention is importantly designed to fit about the perimeter of the exhaust duct. However, for a typical grease exhaust system 10 that is squared shaped, the grease containment assembly 20 includes corners 11 or angled sections, for which the plurality of elongated members 22 are interconnected about each corner 11 by a corner section 50. But, if the grease exhaust system 10 was irregularly shaped or had a circular perimeter, the frame would be designed to fit around the same. As such the elongated members interconnect to form an inside perimeter 23 that is substantially the same as the outside perimeter of the exhaust duct 14.

It is also important to note that preferably the elongated members and corner sections are made from a light-weight material such as PVC. However, other materials that are also fire retardant may be used.

Figure 3:
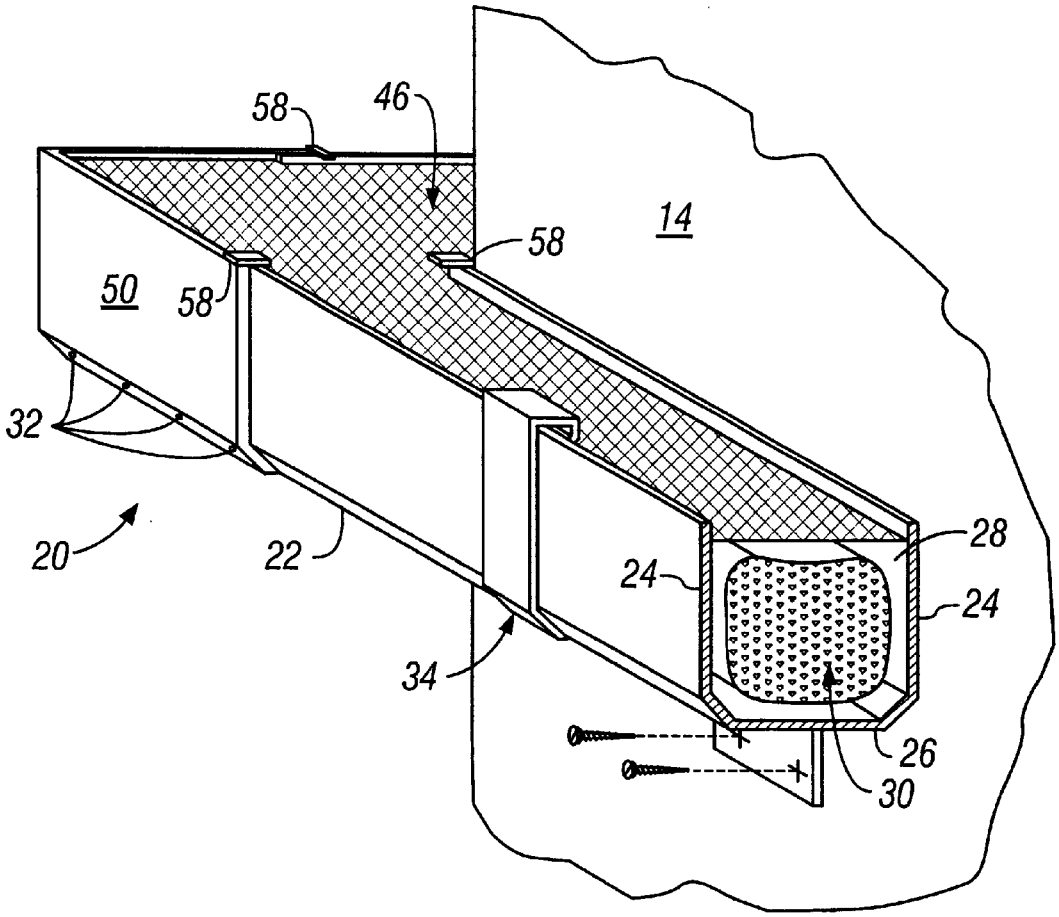
FIG. 3 is a perspective view and partial cross sectional view of the grease containment assembly from FIG. 1.

Referring now to FIG. 3, each elongated member 22 has a U-shaped cross section defined as two side portions 24 that extend upwardly from a bottom portion 26 forming a channel 28 therebetween. The elongated members 22 are positioned against the exhaust duct 14 such that one of the side portions 24 is resting up against the exhaust duct 14. Positioned in the channel 28, also referred to as the interior region, is a sorbent pad 30 that is preferably sized to fit within the two side portions 24 and rest against the bottom portion 26. The sorbent pad 30 is suitable for absorbing air-borne grease discharged from the discharge vent. The sorbent pad 30 is further capable of passing any water landing on the sorbent pad 30 that was either discharged from the discharge vent or caused from precipitation. As opposed to the prior art, where a sorbent pad is positioned up against the exhaust duct 14, which allows grease to seep in between the sorbent pad, the present invention places the sorbent pad 30 entirely within elongated members such that the grease cannot seep in between the sorbent pad 30 and the exhaust duct 14. In addition thereto a portion of the elongated members further includes a plurality of drain holes 32 that drain any water repelled by the sorbent pad 30.

The elongated members 22 are further secured to the exhaust duct 14 such that the elongated members may be raised above the roof 18. Since in some instance the roof 18 may be tilted or unleveled, positioning the grease containment assembly 20 against the roof 18 may cause grease of other fluids to run and collect about a single area, which would cause the sorbet pad 30 to be saturated in an area. As such it is advantageous to attach the grease containment assembly 20 at a level position. The aforementioned securing means is preferably a plurality of support brackets 34.

Referring now to FIG. 4, each support bracket 34 has a first edge 36 and a second edge 38. The first edge 36 is secured to the exhaust duct 14 by screws 37, or other fastening means, while the second edge 38 includes a contour 40 that matches the contour of the elongated member 22 that it is supporting. More specifically, the contour 40 at least supports the bottom portion 26 and the side portion 24 of the elongated member. The second edge 38 further includes a resilient flange 42 that extends around the top portion 25 of the aforementioned side portion 24, such that the flange 42 may engage the side portion 24 thereby securing the elongated member 22 in position against the exhaust duct 14.

To further guide any discharged grease into the grease containment assembly 20, a flash guard 44 may be positioned about the perimeter of the exhaust duct 14 in between the grease containment assembly 20 and the fan base 16. The flash guard 44 may be secured to the exhaust duct 14, by screws 37 or other fastening means, under the fan base 16 such that any grease seeping from the fan base 16 would run down the flash guard 44 and into the grease containment assembly 20.

The grease containment assembly 20 may also include a mesh covering 46 to limit access to the sorbent pad 30. Such limited access may be desired to keep animals out of the grease containment assembly 20 or to protect the sorbent pad 30 from harsh or windy environments. The mesh covering 46 is held in place by clips 48 (FIG. 4) defined in the side portions 24 of the elongated members 22. The clips 48 protruding inwardly towards the center of the elongated member 22 and are further defined to hold the mesh covering 46 in position.

Figure 5:
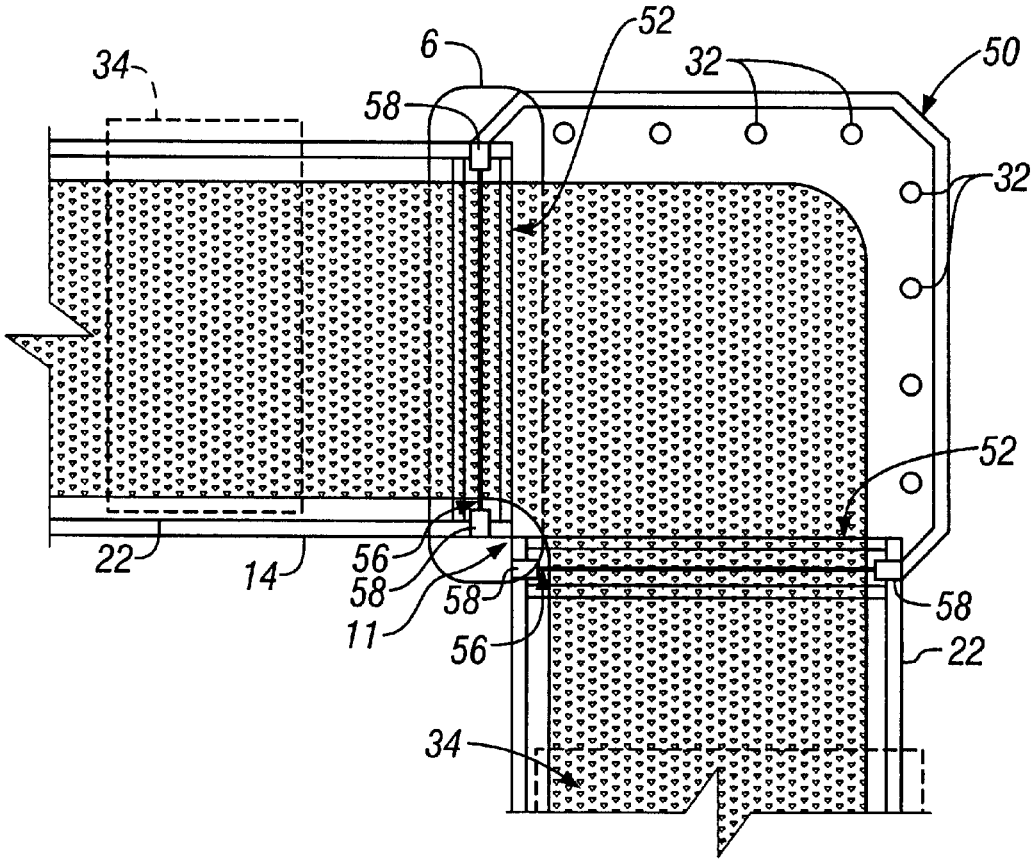
FIG. 5 is a top enlarged view of the corner section of the grease containment assembly from FIG. 2.
Figure 6:
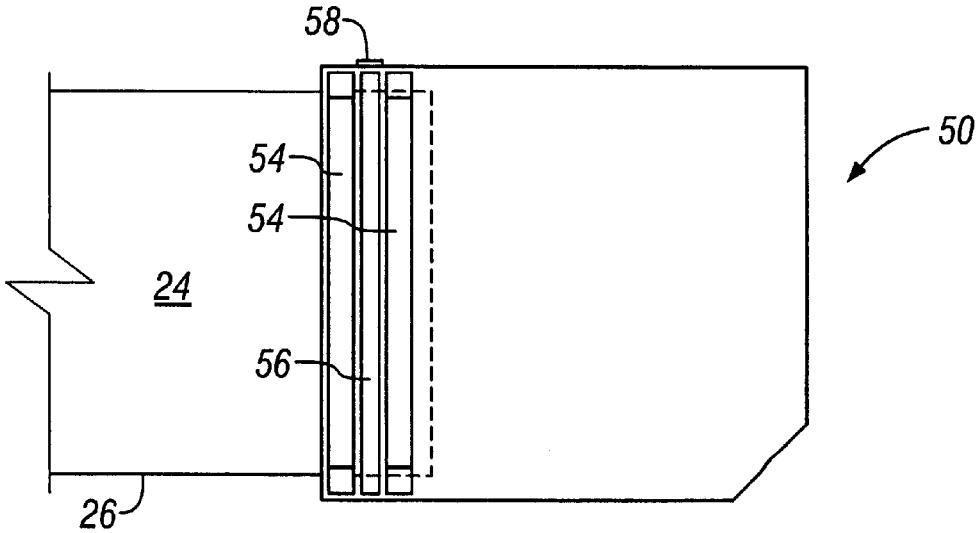
FIG. 6 is a side sectional view of the enlarged corner section about section 6.

Referring now to FIG. 5, two elongated members 22 are connected around a corner II by a corner section 50. The corner section 50 includes at least two openings 52 that include a similar but slightly larger contour then the elongated members 22 in order to receive the elongated members 22. In addition, each opening 52 has a support 54 cast into the inside perimeter. The support 54 is defined to receive a U-shaped rubber gasket 56, such that when assembled, the elongated member 22 is positioned into the corner section 50 and onto the rubber gasket 56 thereby creating a seal to prevent grease or other containments from leaking from the grease containment assembly 20. To secure the elongated member 22 into the corner section 50, the corner section 50 includes a pair of opposing resilient tabs 58 that frictionally engage the two side portions 24 of the elongated member. While the plurality of drain holes 32 may be positioned through the elongated members 22, in the embodiment illustrated, the drain holes 32 are positioned in bottom portion of the corner section 50.

Figure 7:
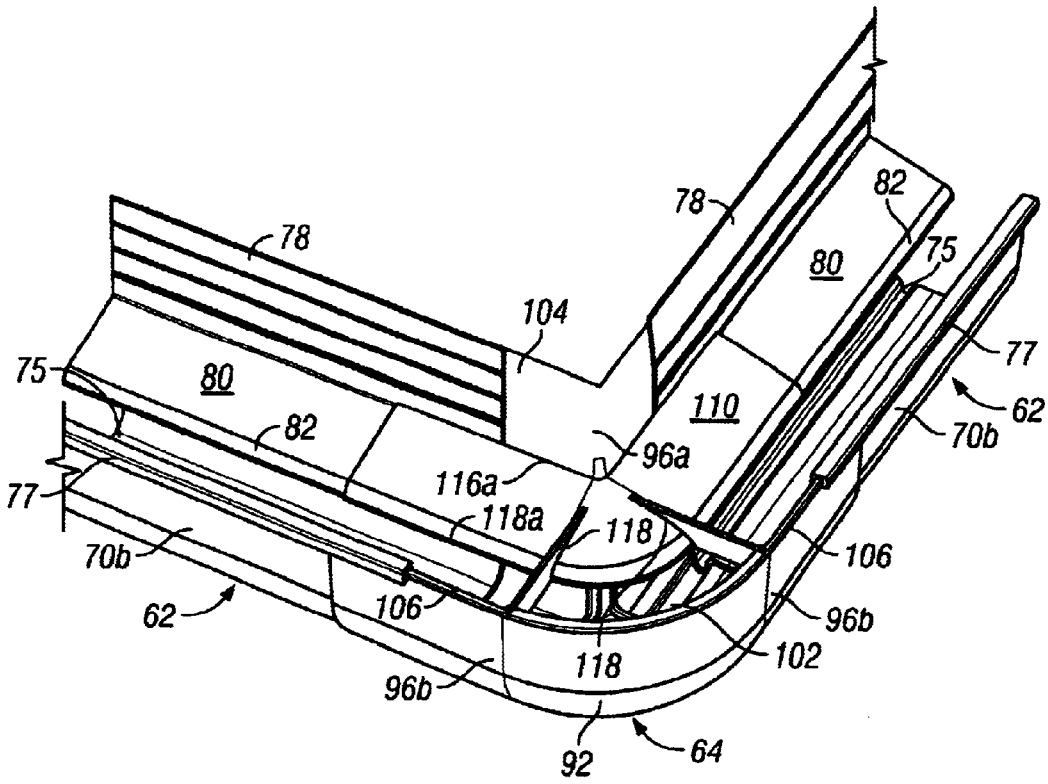
FIG. 7 is a perspective view of another embodiment of the present invention.
Figure 8:
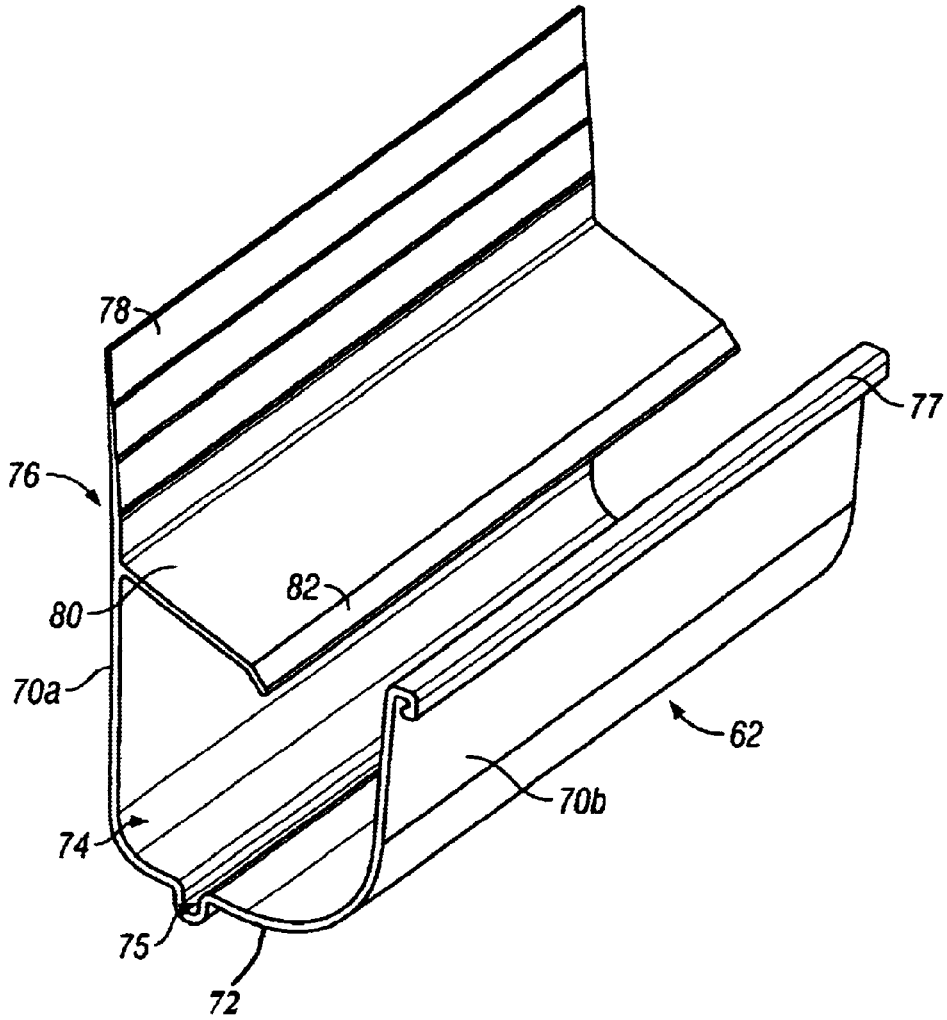
FIG. 8 is a perspective view of an elongated member defined for the embodiment in FIG. 7.

In yet another embodiment, a portion of another grease containment assembly 60 is illustrated in FIGS. 7–11. The grease containment assembly 60 includes a plurality of elongated members 62 that are interconnected and positioned against the exhaust duct 14 and below the fan base 16. To wrap around corners or angles defined by the exhaust duct 14, the elongated members 62 are connected to a corner member 64. Turning now to FIG. 8, each elongated member 60 may be further defined.

Each elongated member 60 includes a pair of side walls 70*a* and 70*b* that extend away from a rounded bottom portion 72 to form a U-shaped channel 74 defined therebetween. The channel 74 is defined to hold the sorbent material, discussed above. Defined on the bottom portion 72 is a water channel 75 that runs the length of the elongated member 60. The water channel 75 as explained in greater detail below provides water repelled by the sorbent material an opportunity to egress.

The side walls 70*a* and 70*b* may be respectively further defined as being a first wall that is proximal to the exhaust duct 14 and a second wall that is distal thereto. The distal wall 70*b* extends for a predetermined distance away from the bottom portion 72 and includes a female flanged section 77 that is shaped to receive a male flanged section, discussed in greater detail below.

The proximal wall 70*a* similarly extends upwardly a predetermined distance away from the bottom portion 72 to form an integral flashing guard 76. The flashing guard 76 includes a resilient portion 78 that extends towards exhaust duct 14, such that when assembled, the resilient portion 78 pushes against the exhaust duct 14 to prevent grease from sliding down the outside of the grease containment assembly 60. Instead of having a screen secured above the elongated members 62, the flashing guard 76 includes a portion 80 that extends outwardly over the channel 72 toward the distal wall 70*b*. The exact length of the extension is not critical to the invention, however, it is preferred to have a length that prevent small animals from entering the channel 72. The edge 82, of the extending portion 80, further extends or slants downwardly. As such grease that is expelled from the exhaust duct 14 will run down the resilient portion 78 of the flashing guard 76, over the extending portion 80 and edge 82 into the sorbent material that is placed in the grease containment assembly 60. Moreover, the extending portion 80 also serves to protect the sorbet pad from UV sunlight that may dry out and deteriorate the sorbet pad. The extending portion 80 may also deflect precipitation and debris a lot better that a screen.

Figure 9:
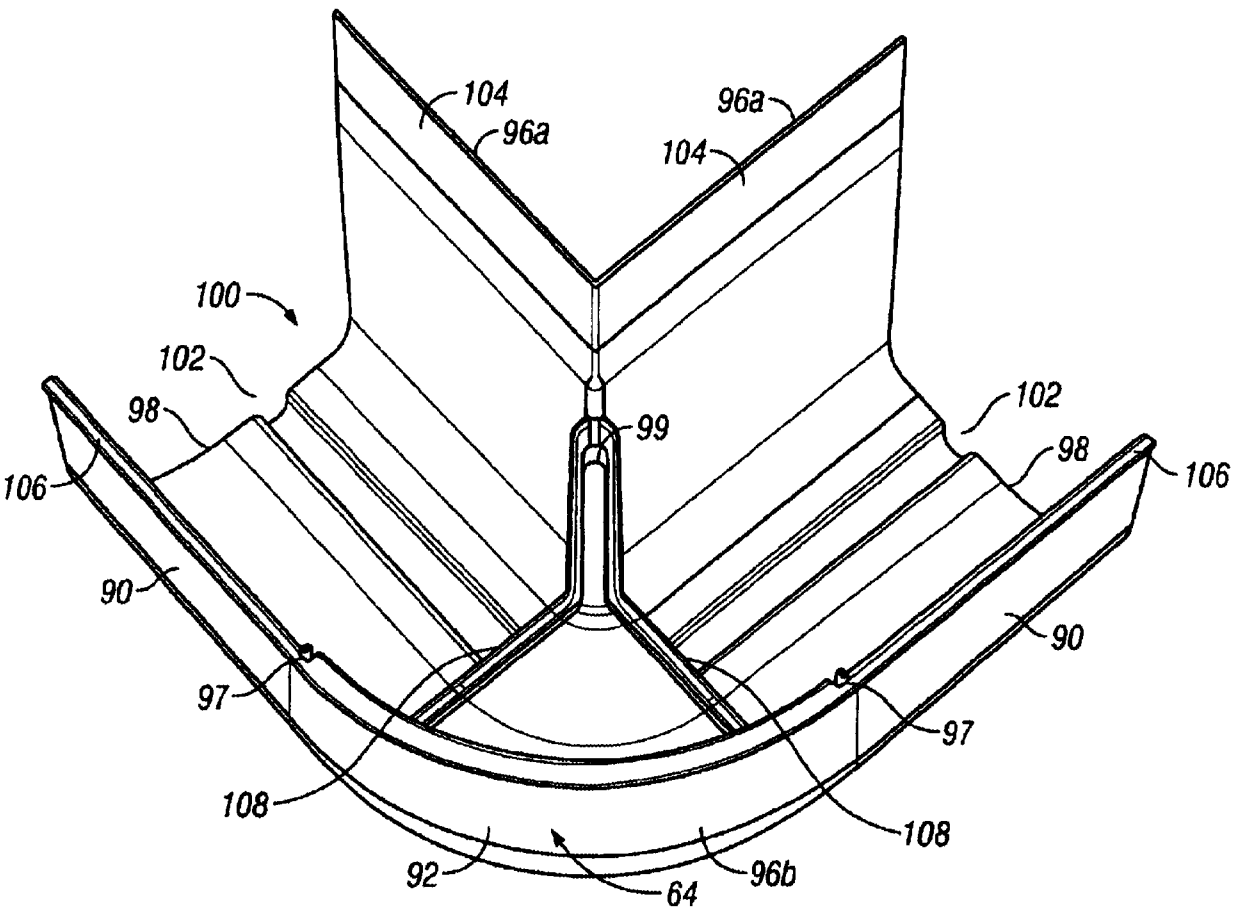
FIG. 9 is a perspective view of a corner member defined for the embodiment in FIG. 7.

As mentioned above, the elongated members 62 may interconnect with each other or connect around a corner, angle or round section of the exhaust duct 14 by connecting to a cornered angled or rounded section, such that the grease containment assembly forms around the perimeter of the duct. Referring now to FIG. 9 a corner section 64 is illustrated. Since the corner section 64 permits two elongated members 62 to connect around the corner of the duct 14, the corner section 64 includes two side members 90 extending away from a middle member 92. The corner section 64 is further defined has having a proximal wall 96*a*, being proximal to the exhaust duct 14, and a distal wall 96*b*, being distal thereto. Both walls 96*a* and 96*b* extend away from a bottom section 98 to form a U-shaped channel 100. The bottom sections 98 of the two side members 90 include a water channel 102 that aligns with the water channels 75 on the elongated members 62 when assembled thereto.

Similarly constructed like the elongated members 62, the walls 96*a* and 96*b* on the corner section 64 extend away from the bottom section 98 a length that would approximately equal to the walls 70*a* and 70*b* on the elongated members 62. The proximal wall 96*a* on the corner section 64 also includes a resilient portion 104 that causes any grease running down the exhaust duct 14 to slide into the grease containment assembly 60.

The distal wall 96*b* includes a male flange 106 that is received in the female flange 77. In addition, the inside profile of the bottom section 98 and walls 96*a* and 96*b* on the corner section 64 matches the outside profile of the bottom section 72 and walls 70*a* and 70*b* on the elongated members 62 such that the elongated members 62 slide into and over the two side members 90 towards the middle member 92. However, it is further contemplated that the profiles can be reversed such that the corner section slides over and into the elongated members.

Figure 10:
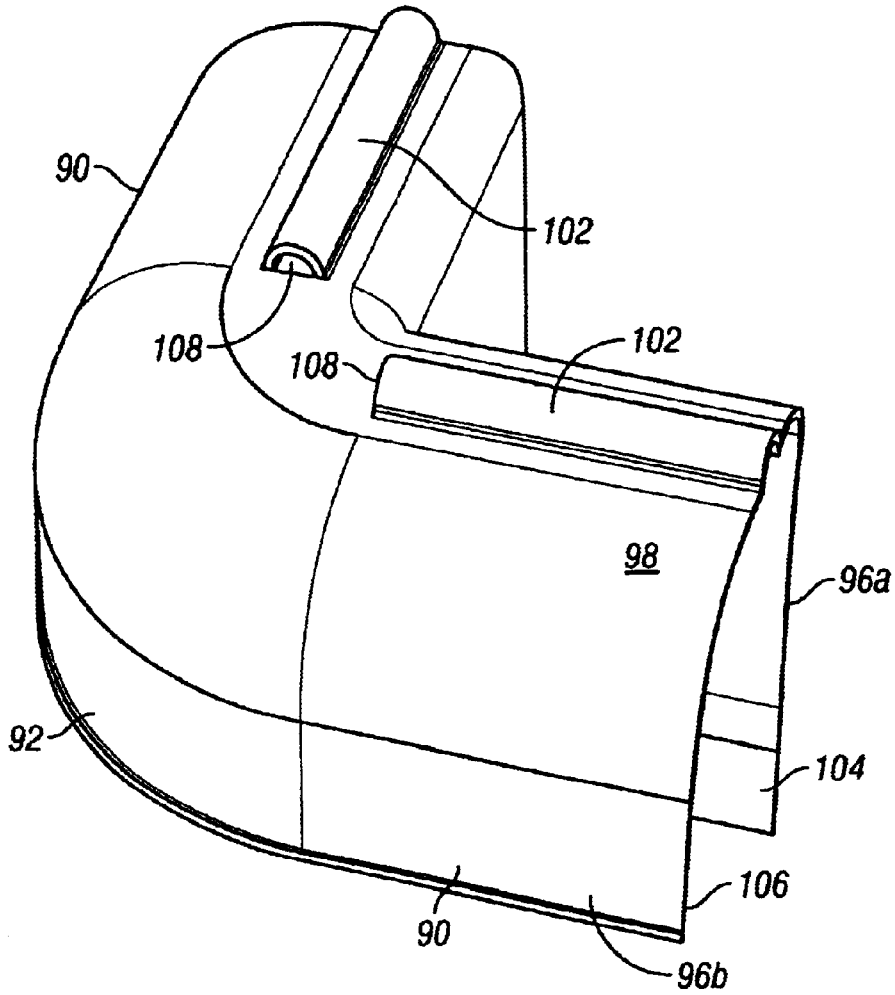
FIG. 10 is a bottom perspective view of the corner member in FIG. 9.

The middle member 92 that connects the two side members 90 includes egresses 108 at a position that aligns with the water channels 102, such that water running along the water channels 75, in the elongated members 62, and the water channels 102, in the side members 90 will be able to exit the grease containment assembly 60, best seen in FIG. 10.

Figure 11:
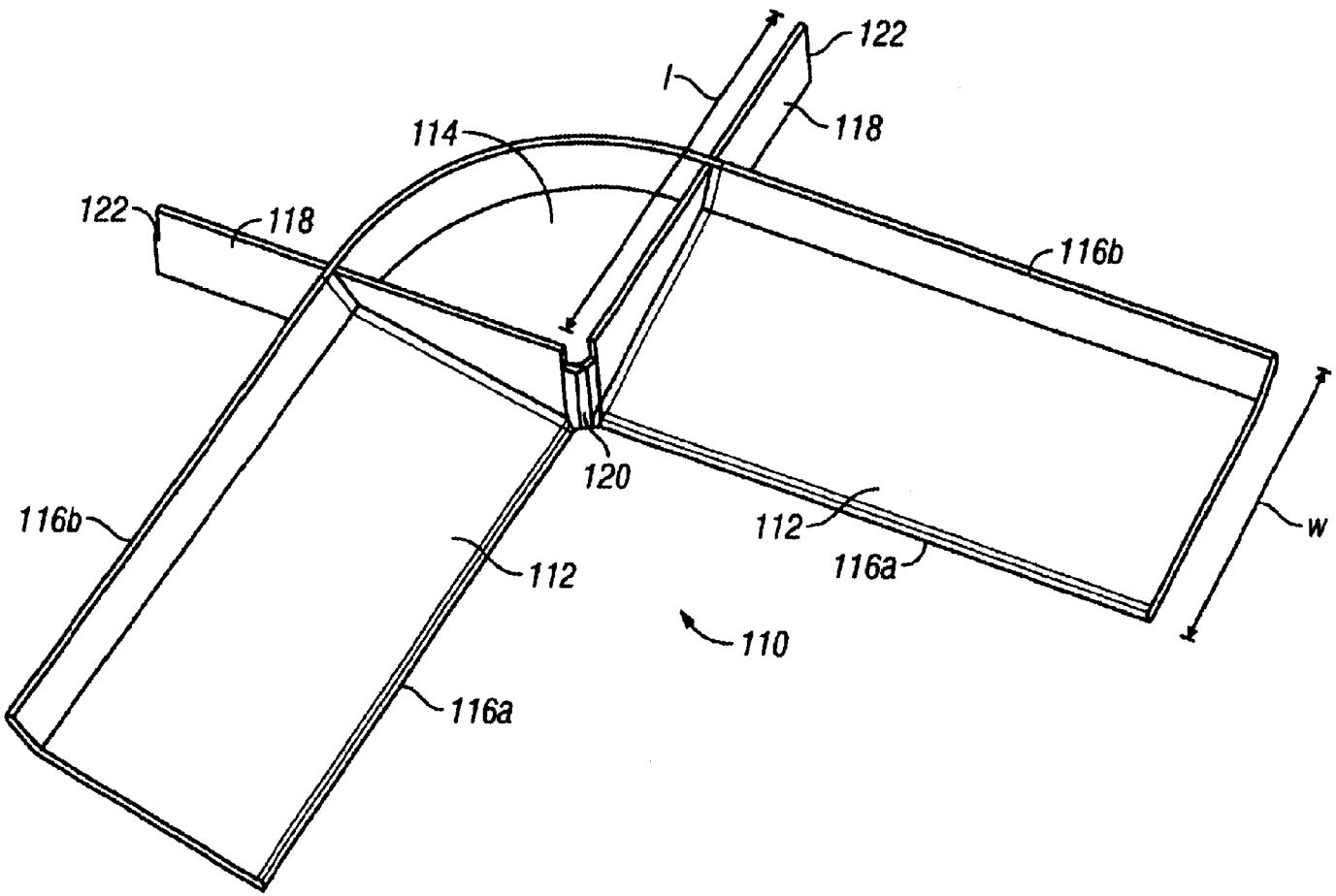
FIG. 11 is a bottom perspective view of the corner flashing section defined for the embodiment in FIG. 7.

While a corresponding extending portion can be integrally molded into the corner sections, the preferred embodiment includes a separate corner flashing section 110 that similarly covers the channel 100, illustrated in FIG. 7 and best shown in FIG. 11. The covering section 110 includes two side sections 112 that extend outwardly from a center section 114. The width w of the corner flashing section 110 is approximately equal to the length of the extending portion 80 on the elongated members 62. The corner flashing section 110 also includes a proximal edge 116*a* and a distal edge 116*b*, defined as the edge proximal to the exhaust duct and the edge distal thereto, respectively. The distal edge 116*b* extends downwardly when viewed as attached to the grease containment assembly 60.

A pair of braces 118 extends outwardly from a post 120 defined on the proximal edge 116*a* in the center section 144. Moreover, the braces 118 have a length l that extends past the width w of the corner flashing section 110. When the corner flashing section 110 is placed on the corner section 64, illustrated in FIG. 7, is easily seen that the length l of the braces 118 extend towards the distal wall 96*b* of the middle member 92. Moreover, the distal wall 96*b* includes guides 97 that are defined to receive the braces 118. The braces 118 may also include notches 122 that may engage detents (not shown) within the guides 97 such that the braces 118 are held in a proper predetermined position. In addition the post 120 on the coming flashing section 110 aligns with and rest upon a post 99 on proximal wall 96*a* defined in the middle member 92. As shown in FIG. 7, the corner flashing section 110 is secured in place and provides the same protection against small animals and flashing function as the flashing guards defined in the elongated members 62.

As previously mentioned with the other embodiments, similar means may be used to attach the grease containment assembly 60 to the exhaust duct 14.

Moreover, it is further contemplated by the present invention to have the elongated members and the corner section with defined profiles other then that is described in the present invention, such that the internal profiles may be V-shaped or irregularly shaped. In such instances of being V-shaped the bottom region of the V-shaped members would act as the water channel. From the foregoing and as mentioned above, it will be observed that numerous variations and modifications may be effected without departing from the scope of the nvention. It is to be understood that no limitation with respect to the specific methods and apparatus illustrated herein is intended or should be inferred. It is, of course, intended to cover by the appended claims all such modifications as fall within the scope of the claims.

What is claimed is:

1. A grease containment assembly positioned about the perimeter of a grease exhaust system having at least an exhaust duct with a predetermined perimeter and that extends from a roof, the exhaust duct further connects to an exhaust fan by a fan base, the grease containment assembly for collecting and containing grease discharged therefrom, comprising:

a plurality of interconnecting elongated members having a U-shaped contour defined by two walls extending away from a bottom portion, the elongated members when interconnected having one wall, of said two walls, proximal to the exhaust duct such that the elongated members have an inside perimeter matching the predetermined perimeter of the exhaust duct whereby the elongated members may be formed around said predetermined perimeter;

a sorbent pad sized to fit within the two walls of the elongated members and rest against the bottom portion, the sorbent pad having properties to absorb grease and to repel water; and a water channel formed along the bottom portion of the elongated members.

2. The grease containment assembly of claim 1, wherein said wall proximal to the exhaust duct extends away from the bottom portion to form a flashing guard such that grease sliding down the exhaust vent is directed into the elongated members.

3. The grease containment assembly of claim 1, wherein the elongated members further include a member extending from the wall proximal to the exhaust duct to said other wall defined as being distal thereto.

4. The grease containment assembly of claim 1 further comprising:

corner sections to connect elongated members at an angle about the exhaust duct, each corner section having at least two side members to receive at least two elongated members, each side member having a water channel and a egress to permit water running through the water channel to exit the grease containment assembly.

5. The grease containment assembly of claim 4 further comprising:

a corner flashing section defined to be placed over a corner section, the corner flashing when placed over a corner section has an edge proximal to the exhaust duct and an edge distal thereto, the corner section further having braces that extend past the distal edge of the corner section and are secured within guides defined in the corner section.

6. A grease containment assembly to be used in combination with a grease exhaust system, the grease exhaust system having an exhaust duct with a predetermined perimeter, which also extends upwardly from a roof, and further having a fan base that connects the exhaust duct to a exhaust fan, wherein the grease containment assembly collects and contains grease discharged therefrom, comprising:

a plurality of elongated members, each elongated member having a pair of walls extending away from a bottom portion to define an interior channel and a water channel defined about the bottom portion thereof, wherein the interior channel and water channel define an external profile;

a plurality of angled members having an interior channel and designed to receive at least two elongated members and angled to match an angled portion of the exhaust duct, each angled member defined by having two side members and a center member, the two side members have an internal profile that matches the external profile of the elongated members such that the elongated members may slide into the two side members, the center member further including egresses that align with the water channels; and a grease absorbent material sized to fit within the interior channel of the elongated members and angled members;

whereby when the elongated members are interconnected to the angled members the grease containment assembly includes a wall proximal to the exhaust duct that has a perimeter that substantially matches the predetermined perimeter of the exhaust duct.

7. The grease containment assembly of claim 6, wherein the elongated members include a wall proximal to the exhaust duct that extends away from the bottom portion to form a flashing guard.

8. The grease containment assembly of claim 7, wherein the elongated members include a wall distal to the proximal wall and the distal wall includes a female flanged edge that receives a male flanged edge defined along a distal wall defined in the angled members.

9. The grease containment assembly of claim 7, wherein the elongated members include a protruding section that protrudes from the proximal wall to the wall distal thereto.

10. The grease containment assembly of claim 9 further comprising a corner flashing section.

11. The grease containment assembly of claim 6 further comprising a means to secure the grease containment assembly to the exhaust duct.

12. A grease containment assembly to collect grease discharged from a grease exhaust system that includes an exhaust duct extending upwardly from a roof top and interconnected to a fan base, the grease containment comprising:

a plurality of interconnecting channels positioned around the exhaust duct to form a frame surrounding said exhaust duct, the interconnecting channels having a water channel defined in a bottom region of the channel;

a sorbent material received within the interconnecting channels, the sorbent material capable of absorbing grease and repelling water;

a plurality of egresses aligned with water channels such that water running along the water channel may be expelled from the interconnecting channels.

13. The grease containment assembly of claim 12, wherein a portion of the plurality of interconnecting channels include a wall that extends away from the bottom portion to form a flashing guard.

14. The grease containment assembly of claim 13, wherein said portion of the plurality of interconnecting channels further include a member extending outwardly from said wall over said channel a predetermined distance.

* * * * *